United States Patent [19]

Ogasawara et al.

[11] 4,147,452

[45] Apr. 3, 1979

[54] METHOD FOR CONSTRUCTING A RECTANGULARLY SHAPED TUNNEL

[75] Inventors: Toshiya Ogasawara; Norimasa Kubo, both of Ohdate; Hiroshi Nagino, Okayama; Mamoru Takeda, Okayama; Masanori Ochiishi, Okayama, all of Japan

[73] Assignees: Dowa Mining Co., Ltd., Tokyo; Dowa Engineering Co., Ltd., Okayama, both of Japan

[21] Appl. No.: 874,318

[22] Filed: Feb. 1, 1978

[30] Foreign Application Priority Data

Feb. 5, 1977 [JP] Japan ..... 52/11928

[51] Int. Cl.[2] ..... E21D 11/10

[52] U.S. Cl. ..... 405/134; 405/139

[58] Field of Search ..... 61/42, 44, 45

[56] References Cited

U.S. PATENT DOCUMENTS

| | | | |
|---|---|---|---|
| 960,940 | 6/1910 | Jackson | 61/42 |
| 1,242,217 | 10/1917 | McAlpine | 61/42 |
| 1,338,030 | 4/1920 | Meem | 61/42 |
| 1,785,096 | 12/1930 | Proctor | 61/42 |
| 4,009,579 | 3/1977 | Patzner | 61/42 |

FOREIGN PATENT DOCUMENTS

| | | | |
|---|---|---|---|
| 1658735 | 7/1970 | Fed. Rep. of Germany | 61/44 |

*Primary Examiner*—Jacob Shapiro

*Attorney, Agent, or Firm*—Wenderoth, Lind & Ponack

[57] ABSTRACT

A rectangularly shaped tunnel is constructed to include an artificial roof, side wall pillars, a center wall pillar and floor portions all extending along the length of tunnel. The artificial roof is formed by sequentially excavating cross cut shafts and by subsequently plugging the thus formed cavities with concrete. Then the portions directly beneath opposite sides and the center of the roof are excavated and filled with concrete to form side wall pillars and a center wall pillar. Thereafter the rock portions covered by the roof and the wall pillars are excavated to form inner hollow tunnel chambers, the bottoms of which are covered by concrete to form floor portions. Iron frames are embedded in the concrete.

8 Claims, 26 Drawing Figures

METHOD FOR CONSTRUCTING A RECTANGULARLY SHAPED TUNNEL

BACKGROUND OF THE INVENTION

The present invention relates to a method for constructing a tunnel or underground facility which has large sized cavities therethrough. More particularly, the present invention relates to a method for constructing a rectangularly configurated tunnel wherein the roof of the tunnel is preliminarily and artificially constructed in the earth, and thereafter the rectangular tunnel of large size is strongly built up.

Despite remarkable progress which has been made in tunnelling techniques, the configuration of most tunnels has remained uncharged. that is, tunnels still have a curved cross section, such as semi-circular or semi-oval sections.

However, it becomes difficult, with the above-mentioned type of tunnel, to excavate the tunnel if the tunnel has a floor width of more than about fifteen meters. This is because of limitations in tunnel height. Further, the enlargement of the tunnel necessitates that further excavation be carried out with a strong shell formed therearound, whereas it is difficult to have a semi-circular or semi-oval shell formed without loosening ground rock around the tunnel. Additionally it is necessary in a tunnel of curved cross section to enlarge the upper or facing area of the tunnel to an extent more than is required for the vehicles to pass through the tunnel. This means the increase of useless and unnecessary tunnel area, which further adds to the amount of excavation necessitated.

In view of the foregoing, a tunnel of large sectional area has not been made with known tunnelling techniques and, instead, a plurality of tunnels are excavated when necessary to fulfill the requirement caused by heavy traffic.

But with recent traffic patterns, the width of the traffic zone is required to be broadened into a double track or driveways having several lanes, and it is desired to have the track running closely parallel to the driveways. This requirement in turn results the serious problem of establishing a reliable technique for forming a tunnel of the necessary width. However, because as mentioned above a tunnel having a curved cross section is confined to have a narrow traffic width, it has been practically impossible to excavate a single tunnel having a width of 20 to 30 meters despite the need therefore.

SUMMARY OF THE INVENTION

The present invention provides a tunnelling technique which satisfies the foregoing requirement of recent traffic patterns. According to the present invention a large traffic tunnel having a width of more than twenty-five meters can be obtained, irrespective of the type of rock therearound, and the useless facing area or curved cross section tunnels can be eliminated.

The present invention relates to a method for constructing a rectangularly shaped tunnel and including the steps of:

(a) constructing an artificial roof along the length of the tunnel by the sequential excavation from gateway shafts of horizontal or gently sloped cross cut shafts and by the subsequent building up of a concrete body from the cavities thus developed, (b) constructing vertical wall pillars by the sequential excavation of portions directly below the opposite sides and the center of the artificial roof along the length of tunnel, and by the subsequent building up of concrete bodies in the cavities developed thereby, (c) forming tunnel shafts by excavating the inner blocks of ground rock defined and covered by the artificial roof and the wall pillars, (d) constructing tunnel floors on the bottoms of the tunnel shafts by filling up concrete thereon.

In the case where a track and a driveway must be provided in a single traffic zone, a two-story tunnel may be constructed. Such a tunnel is provided by first constructing a normal tunnel and then repeating the same process steps as mentioned above with the floor of the normal tunnel serving as an artificial roof of a lower tunnel.

BRIEF DESCRIPTION OF THE DRAWINGS

The method according to the present invention will now be described with reference to the attached drawings wherein:

FIG. 26 schematically illustrates a two-story tunnel.

DETAILED DESCRIPTION OF THE INVENTION

Figure 1:
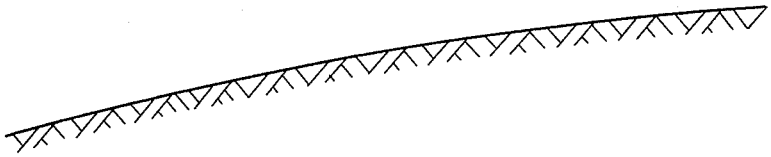
FIG. 1 is a schematic cross sectional view of the portions to be excavated to form a tunnel.
Figure 1:
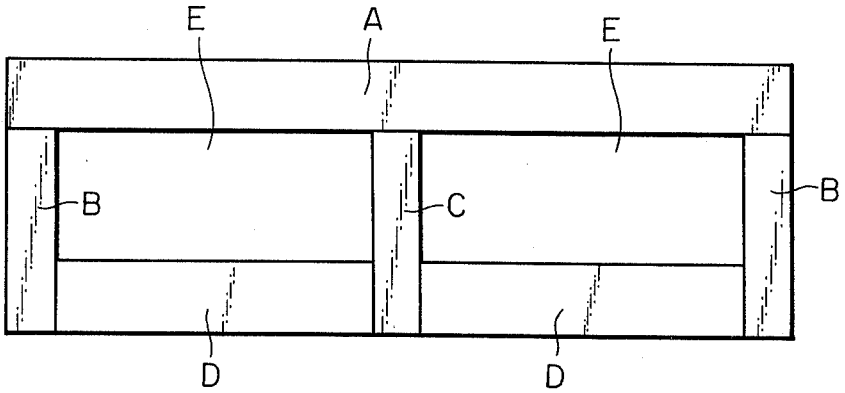

In FIG. 1, the underground construction provided by the present invention is shown in cross section to particularly explain each of the portions formed by the method of the present invention. For clarity of explanation these respective portions will be designated as follows.

A: artificial roof
B: side wall pillar
C: central wall pillar
D: floor block
E: inner block According to the present invention the artificial roof is first constructed and stands against the pressure of upper ground rock. The side wall pillars and a central wall pillar are then constructed. Thereafter, the areas of inner blocks E and floor blocks D are excavated to form tunnel shafts to allow construction of floor blocks D. Each of these operations is succeedingly carried out in close correlation with the other operations in a manner such that the structure and workers are protected from the pressure caused by the ground rock therearound.

In an example, the underground construction according to the present invention is dimensioned such that the artificial roof is 33m×3m×lm. The side wall pillars and center wall pillar are 8.4m×2m×1m, each of the floor blocks is of 13.5m×3m×lm, and each tunnel shaft is 13.5m×5.4m×lm. In this example the term "l" means tunnel length.

The detail of each of the sequential operations is as follows.

[A] Construction of Artificial Roof

(FIGS. 2 to 13 Inclusive)

Gateway shafts which will be detailed hereafter are bored longitudinally of the tunnel direction, and then rectangular and horinzontal cavities are excavated laterally from opposite sides of the upper gateway shaft, and thus formed cavities are subsequently filled with concrete.

Figure 2:
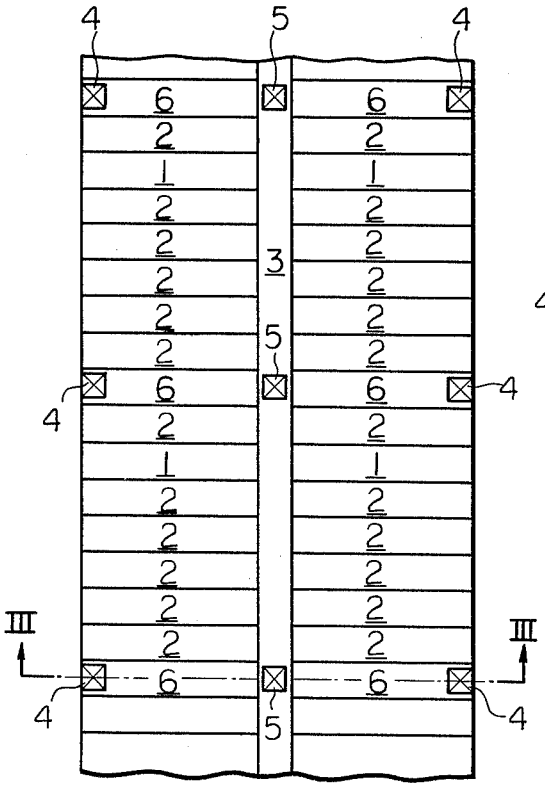
FIG. 2 is the plan view illustrating the manner of the artificial roof.
Figure 3:
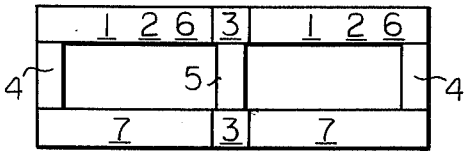
FIG. 3 is a cross sectional view taken along line III—III in FIG. 2.

For clarity of explanation, the reference numerals shown in FIG. 2 and FIG. 3 are defined as follows.

1: Primary cross cut. This is a shaft or cavity, all sides of which are ground rock.

2: Secondary cross cut. This is a shaft or cavity, one side of which is concrete, but the other sides of which are ground rock.

3: Gateway shaft. This shaft or cavity is bored through the ground rock along the center vertical plane of the intended tunnel. One gateway shaft is located at the top of the center plane of the intended tunnel while another gateway shaft is located at the bottom of the outer plane. The gateway shafts serve as passageways when the cross cuts are excavated.

4: Service shaft for movement of workers and equipment. The services shafts are used to form pillars at a latter stage of construction.

5: Chute or shaft for receiving and conveying discharged muck. The chutes are used to form pillars at a latter stage of construction.

6: Upper connecting shaft. These are upper passageways for connecting the upper gateway shaft 3 and the service shafts 4.

7: Lower connecting shaft. These are lower passageways for connecting the lower gateway shaft 3 and the service shafts 4.

The sequential steps for constructing the above-mentioned artificial roof are as follows.

Figure 4:
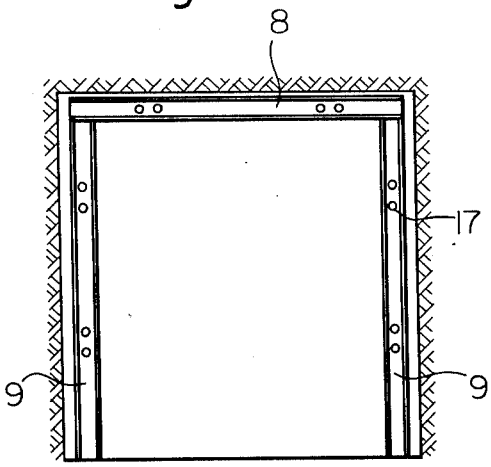
FIG. 4 is a section of a gateway shaft.

(a) At first two gateway shafts, that is upper gateway shaft 3 and lower gateway shaft 3, are excavated through the whole length of the intended tunnel. In this operation H-shaped upper steel frames 8, H-shaped steel stems or columns 9 and tie rods 17 are used for support as shown in FIG. 4.

(b) Next, connecting shafts 6 and 7 are bored on opposite sides of each of gateway shafts 3 at positions spaced longitudinally therealong. The connecting shafts may be developed horizontally or alternatively with a gentle slope, and the distance between adjacent connecting shafts ranges from twenty meters to thirty meters, for instance. The connecting shafts are also supported by means of H-shaped steel members as shown in FIG. 4.

Figure 5:
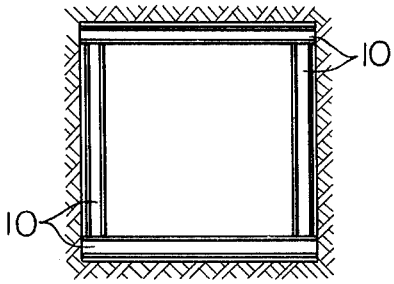
FIG. 5 is a plan view of a vertical service shaft.

(c) Service shafts 4 for conveying workers and equipment are bored vertically to connect the ends of connecting shafts 6 and 7. FIG. 5 is a plan view of a service shaft 4 supported by H-shaped steel members 10.

(d) Muck chutes 5 are bored to connect the upper and the lower gateway shafts 3.

(e) After the above-mentioned preliminary operations are completed, the primary cross cuts 1 are excavated starting from opposite sides of the upper gateway 3.

Figure 6:
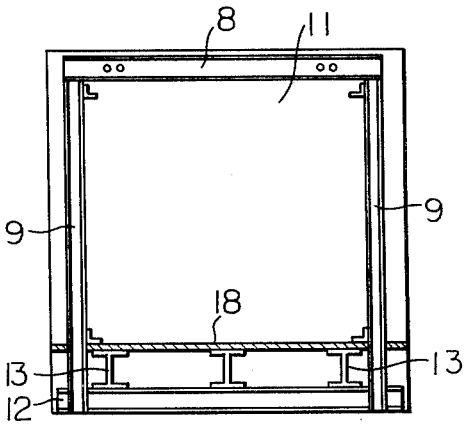
FIG. 6 illustrates the frame structure in a cross cut shaft taken in cross sectional view of the shaft.
Figure 7:
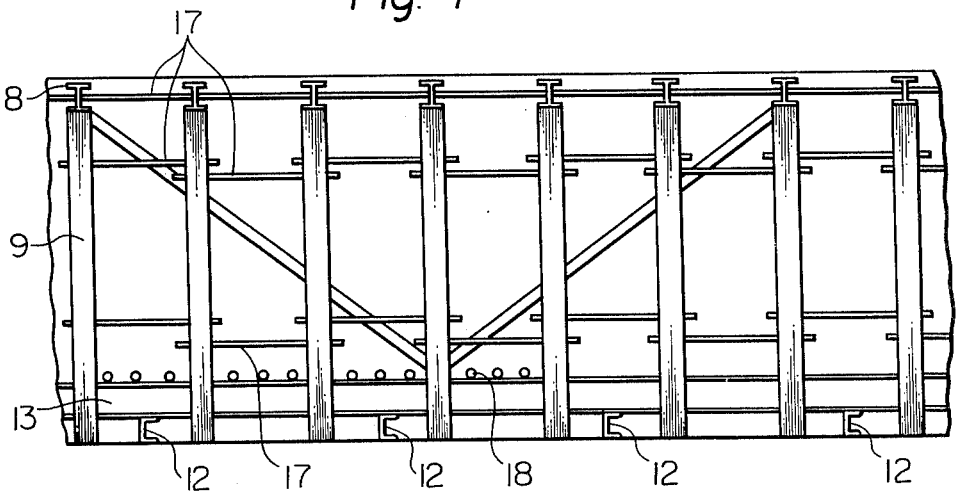
FIG. 7 also illustrates the frame structure in a cross cut shaft, taken in a longitudinal view.

(f) Subsequent to the development of a primary cross cut 1, iron frames are constructed in the cavity thus formed, as shown in FIG. 6 and FIG. 7, and such cavity is then filled with concrete. In detail, H-shaped upper steel frames 8, H-shaped steel stems or columns 9 and tie rods 17 are provided and remain imbedded in the concrete. Channel shaped steel members 12 are laid on the floor of the cavity 11 formed by cross cut 1, and H-shaped steel members 13 are laid on members 12 along the axis of the cavity. A bundle of iron bars may be used instead of the members 13. Joint portions of the members 13 are all fixed by welding. Iron frames 18 are added on members 13 and also welded. Immediately after the construction of these frames, the cavity 11 formed by the primary cross cut is plugged with concrete.

(g) After the concrete in the cavity of the primary cross cut portion becomes solid, plural secondary cross cuts 2 are sequentially excavated and plugged with concrete laterally of the primary cross cut. Thus, the cross cut 2 which is adjacent and parallel to the primary cross cut 1 is excavated. Iron frames are constructed as mentioned in previous paragraph (f) and thereafter plugging with concrete is carried out. When the concrete becomes solid, a next adjacent secondary cross cut is excavated. Iron frames are disposed and plugging with concrete is carried out. As will be understood, during excavation of this next adjacent cross cut 2, one of the side walls thereof is already formed as a concrete wall, while the other walls will be of ground rock surface. The volume plugged with concrete is thus gradually enlarged, to thereby gradually form the roof of the tunnel.

Figure 8:
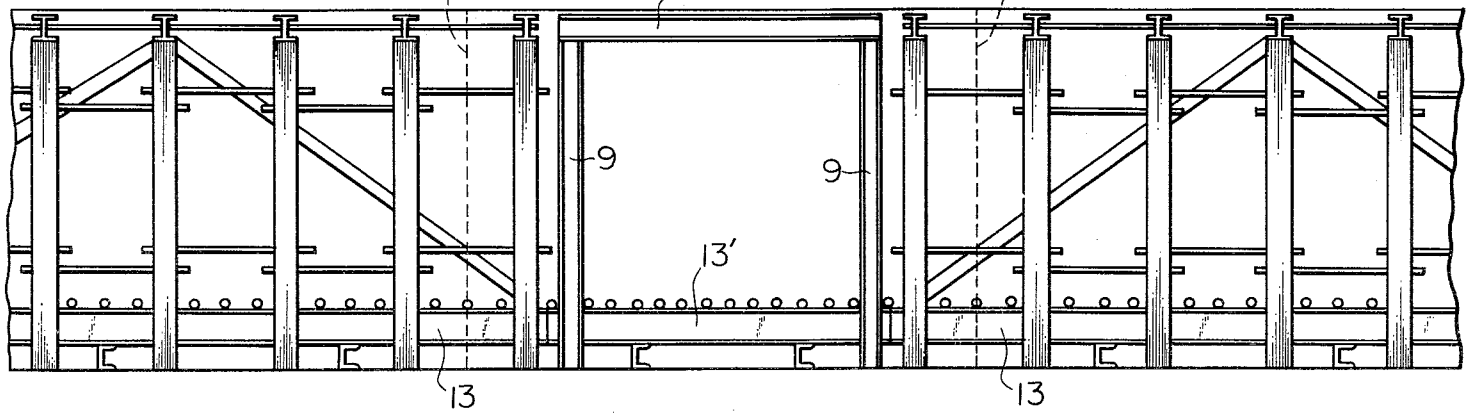
FIG. 8 is a sectional view illustrating the connection of the gateway shaft with cross cut shafts.

FIG. 8 is a cross sectional view taken along a cross cut and illustrates the connection of the gateway shaft 3 with the cross cut shaft. H-shaped steel members 13 in the oppositely developed cross cut shafts are connected by means of an H-shaped steel member 13' extending across the gateway shaft 3. These members are jointed by welding. Numeral 20 in FIG. 8 designates the concrete face as formed.

Figure 9:
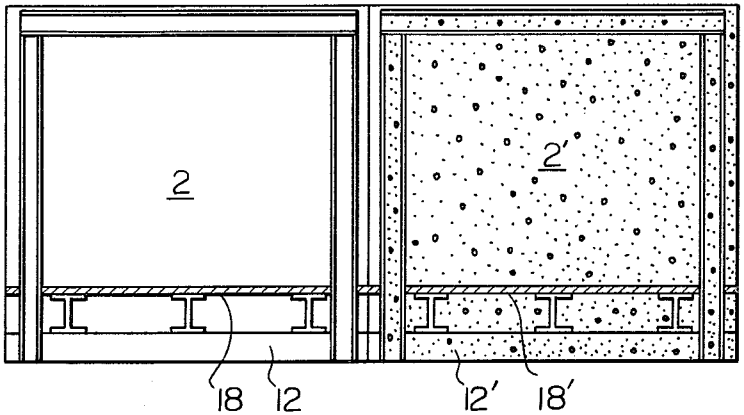
FIG. 9 is a sectional view illustrating the connection between adjacent cross cut shafts.

FIG. 9 is a cross section illustrating the connection between the solid concrete filling a cross cut 2' (either the primary cross cut or one of the secondary cross cuts) and the adjacent cross cut 2 after excavation thereof and having framing therein. As shown therein, the channels 12' and 12 are connected by welding. Iron frames 18' and 18 are also connected in the same manner. After that, the cross cut 2 is plugged with concrete.

Figure 10:
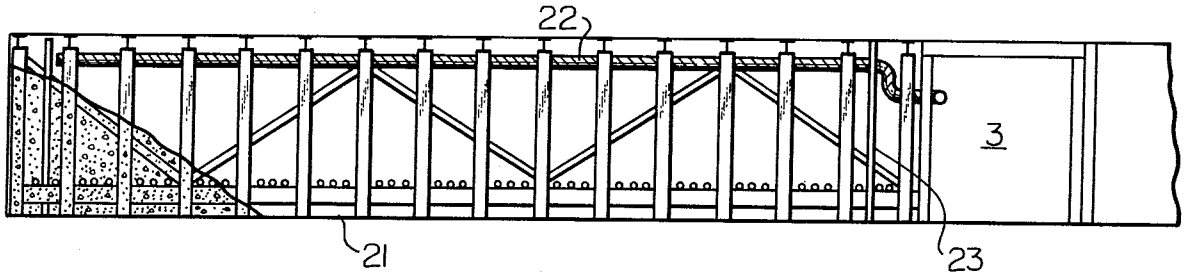
FIG. 10 is a sectional view wherein plugging by concrete is shown.

The cross section of FIG. 10 is illustrative of the system for plugging each of the cross cuts with concrete. When the construction of the iron frames in a cross cut is completed, sand is spread on the floor and is covered by a vinyl sheet 21 or the like for the purpose of preventing muck from sticking to the concrete surface which will otherwise be exposed in a latter stage of construction.

Next, a conduit 22 for supplying concrete under pressure is disposed horizontally or at a gentle slope to extend the length of and close to the ceiling of the cross cut.

A barrier plate 23 which serves as a molding frame is provided to define the inner boundary of the concrete body. Edges of channels and iron frames located at the ground rock surface side of the cross cut are kept free from the raw concrete by a partition so as not to cause difficulties when they are connected with those of the next adjacent cross cut.

When the foregoing steps are completed, raw concrete is supplied from an exteriorly positioned concrete truck, and the raw concrete is delivered through the pipe 22. The concrete must be cured for two or three days.

(h) By virtue of the process thus far explained, a united slab of concrete is formed by repeating the sequential and desirably alternative operations of cross cut excavation and concrete plugging. These operations are carried out in directions transverse to the upper gateway shaft 3 and in horizontal or gently sloped directions.

This formation of concrete slab of the roof is effected in sequential manner and, when the concrete plugging covering a predetermined volume (the volume between adjacent service shafts) is completed, the gateway shaft 3 itself has inner frames disposed therein. The upper gateway shaft 3 is then plugged with concrete to thus form a fully united concrete slab having no hollows or gaps therein. The next and subsequent sections of the roof are then developed in the same way to complete the entire solid roof of the tunnel.

It is sometimes unavoidable to have a few minor cavities formed between the ground rock surface and the concrete body.

Figure 11:
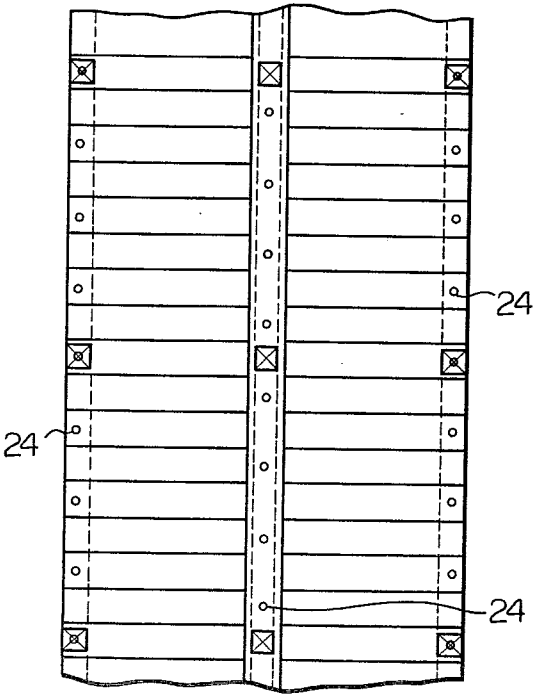
FIG. 11 is a plan view which shows back filling of the artificial roof.
Figure 12:
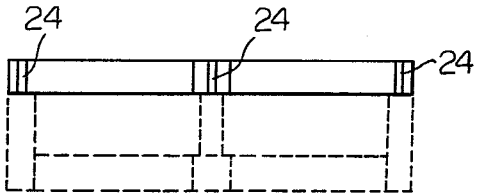
FIG. 12 is an elevational view of the features of FIG. 11.

Such a type of cavity is undesirable from the standpoint of supporting the pressure of rock. For the purpose of eliminating such minor cavities, grouting pipes 24 are provided adjacent the outer ends of the cross cuts and at suitable spots on the gateway shaft as shown in FIG. 11 and FIG. 12. These pipes may be used to perform back-filling with mortar at the stage of wall pillar formation which will be effected later. Also, the minor cavities which may be found at the head of a preceding concrete body must be cautiously plugged with concrete at the time when plugging of the adjacent cross cut is carried out.

[B] Construction of Wall Pillars (FIGS. 13 to 19 inclusive)

After an artificial roof A is formed by the above-mentioned process, excavation is carried out at the areas directly beneath the opposite sides and the center of the roof. The cavities thus formed are subsequently plugged with concrete to form vertical wall pillars. In this connection it is convenient, in view of the discharge of muck, to defer the formation of the center wall pillar C.

Figure 13:
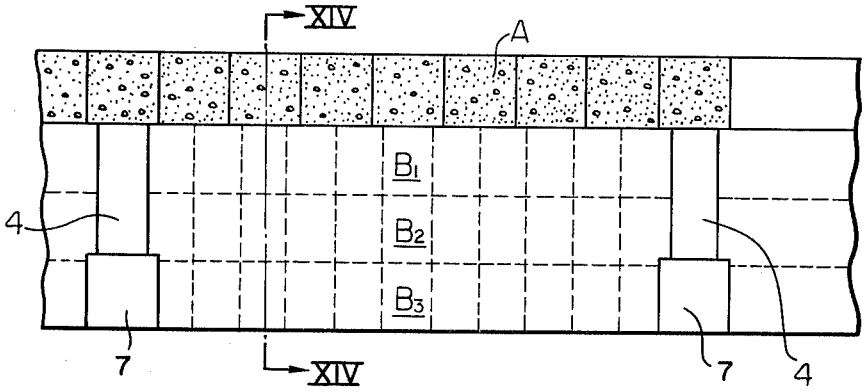
FIG. 13 is a longitudinal sectional view of a portion designed to be excavated to form a side wall pillar.
Figure 14:
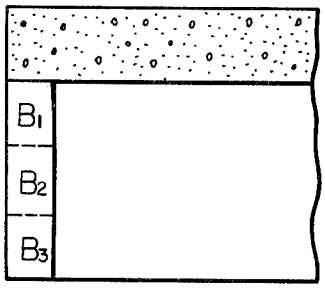
FIG. 14 is a sectional view taken along line XIV—XIV in FIG. 13.

FIG. 13 illustrates the vertical section of the portion directly under one side of the artificial roof A, wherein a side wall pillar is intended to be formed. FIG. 13 includes the cross section extending from one service shaft 4 to an adjacent service shaft 4. FIG. 14 is the section taken along line XIV—XIV in FIG. 13. To excavate this portion, the service shafts 4 and connecting shafts 7 are used to begin the excavation. In an example, excavation thereof is carried out as shown in these drawings, wherein the portion to be excavated is divided into three layers $B_1$, $B_2$ and $B_3$. These layers are sequentially excavated beginning from the upper layer $B_1$. The layers $B_2$ and $B_3$ are subsequently excavated to form a stair-like excavation surface.

Figure 15:
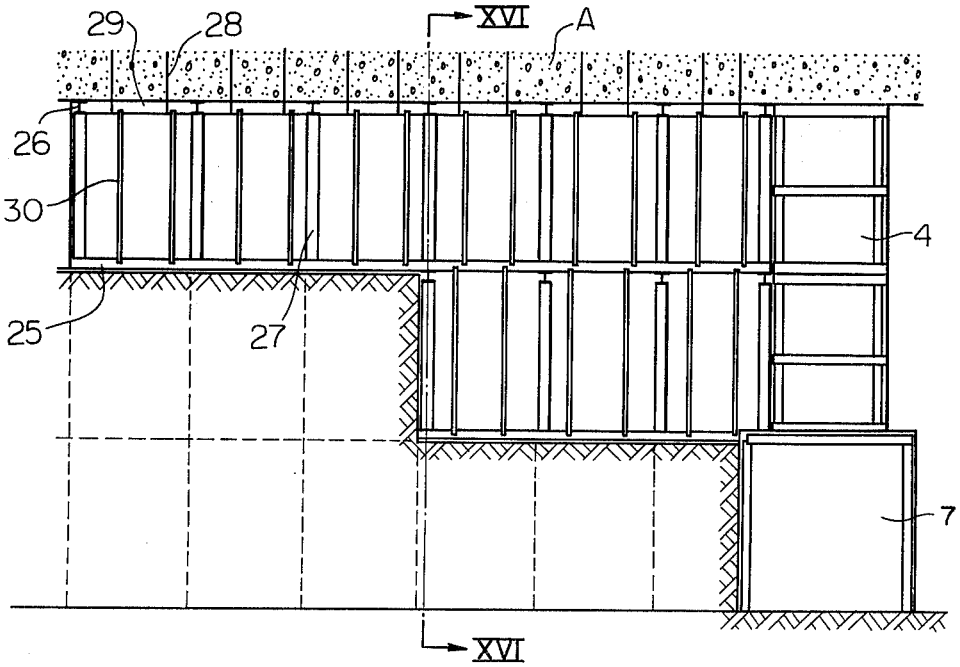
FIG. 15 is a longitudinal sectional view illustrating the system of excavating a side wall pillar.
Figure 16:
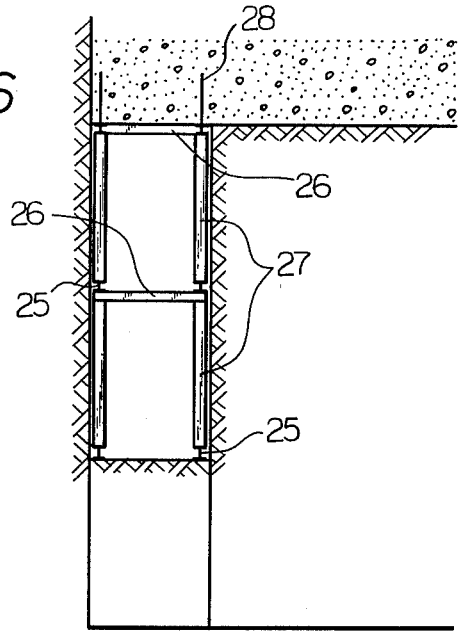
FIG. 16 is a sectional view taken along line XVI—XVI in FIG. 15.

FIG. 15 details the system of excavation referred to above, and FIG. 16 illustrates a section taken along line XVI—XVI in FIG. 15. As shown, H-shaped steel members 25 are laid on the floor of each excavated layer. H-shaped steel stems or columns 27 are set on the members 25 and support upper H-shaped steel frames 26.

During excavation of upper layer, H-shaped steel members 29 are hung from the artificial roof A by means of anchor volts 28 sunk into the roof to prepare excavation of lower layer. Hanger volts 30 hanging from the steel members 29 are designed to hang the H-shaped steel members 25 laid on the floor. In this way excavation proceeds while being supported by the iron frames. When excavation and disposition of frames are completed to cover the volume of twenty-four meters length between adjacent service shafts 4, plugging with cement is carried out in accordance with the manner shown in FIG. 17 and FIG. 18.

Figure 17:
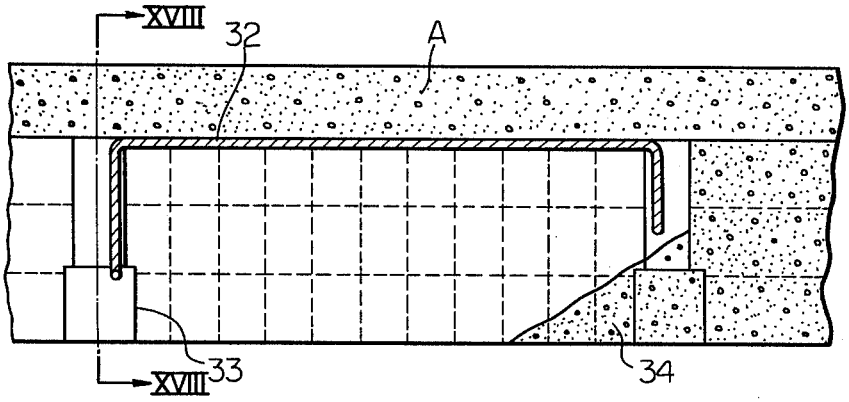
FIG. 17 is a longitudinal sectional view wherein plugging of a side wall pillar by concrete is shown.
Figure 18:
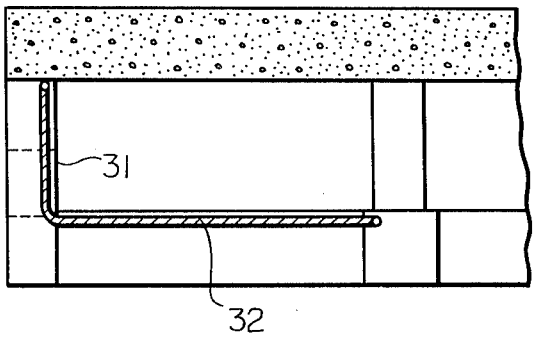
FIG. 18 is a cross sectional view taken along line XVII—XVII in FIG. 17.

FIG. 17 is a vertical sectional view illustrating the plugging operation, and FIG. 18 is a cross section taken along the line XVIII—XVIII in FIG. 17. At first, forms 31 of steel are fixed on the inner surface of the side wall. This is for the purpose of eliminating muck which would otherwise appear on a concrete surface in the latter stage, and is also for the purpose of facilitating excavation in the latter stage. Then a delivery pipe 32 is disposed as shown in the drawing to supply concrete. A barrier wall 33 is attached to the boundary of the concrete body. Thereafter raw concrete 34 is discharged from an exteriorly positioned concrete truck through the delivery pipe 32.

Figure 19:
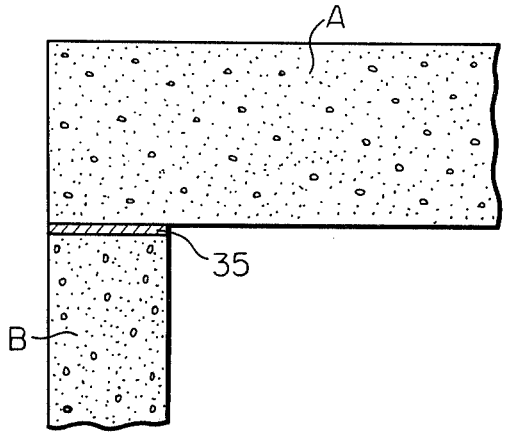
FIG. 19 is an enlarged sectional view indicating the connection between an artificial roof and a side wall pillar.

One of the side wall pillars B is thus completed at the specified location. For compensating for incomplete plugging which may sometimes occur, junction 35 is coated by cement mortar as shown in FIG. 19.

After a portion of one side wall pillar is completed in a predetermined location, the next portion of the pillar is prepared following the completion of the artificial roof.

The process for forming a center wall pillar C as shown in FIG. 1 is the same as that of the side wall pillar. It was found practically convenient to somewhat defer the formation of the center pillar from that of side pillars.

Figure 20:
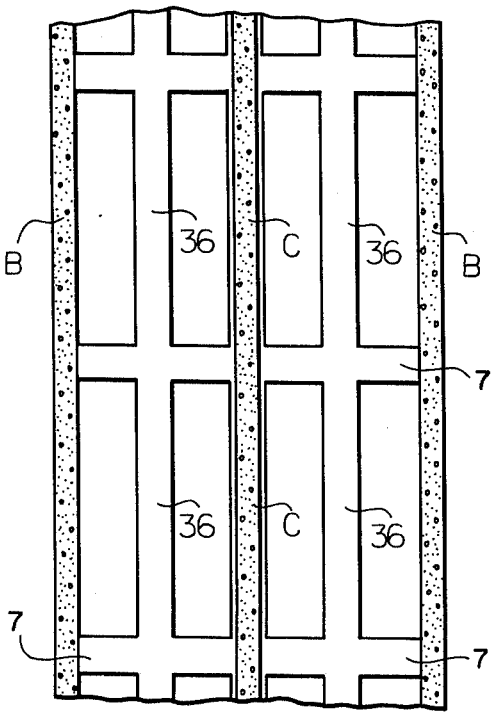
FIG. 20 is a plan view of the inner block area.
Figure 21:
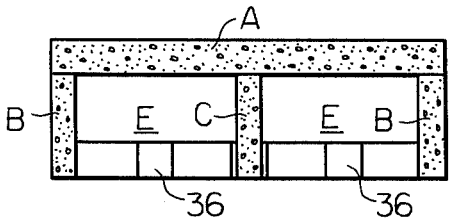
FIG. 21 is an elevational sectional view of FIG. 20.
Figure 22:
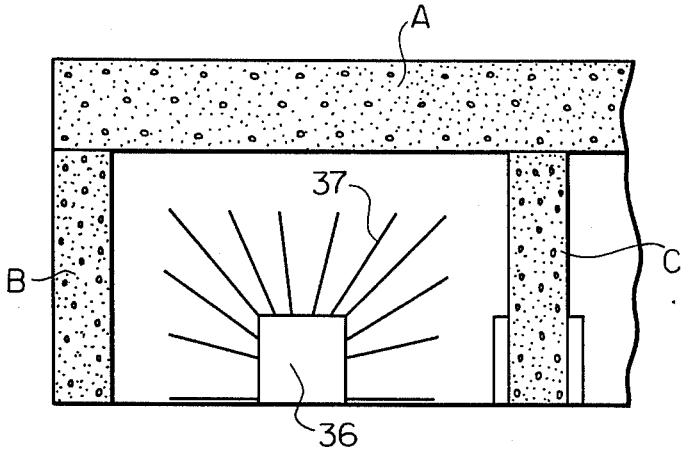
FIG. 22 is a sectional view illustrating semi-long hole boring to remove the inner block portion.

[C] Excavation of Inner Blocks (FIGS. 20 to 22 inclusive)

The volumes of inner blocks E and floor blocks D which are covered by the united concrete body consisting of the artificial roof A and the wall pillars B and C shown in FIG. 1 can be excavated and removed by whole face blasting using semi-long holes bored outwardly from a shaft.

FIG. 20 is a longitudinal sectional plan view of the inner chamber, while FIG. 21 is an elevational view thereof. At first, a shaft 36 for boring is bored through the bottom center of each of the inner blocks of rock. Next, as shown in the enlarged elevational sectional view of FIG. 22, semi-long holes 37 are bored outwardly from the opening of the shaft 36. Blasting powder is mounted in suitably spaced apart positions in the bores, and whole face blasting is sequentially effected to break out and remove the ground rock forming the inner block within roof A and pillars B and C. The muck resulted from the blast is then discharged.

Hollow tunnel chambers of rectangular form are thus formed, such chambers being defined and covered by the unit consisting of the artificial roof A and the side wall pillars B as well as the center wall pillar C. Such tunnel chambers are the essential parts of the tunnel.

Figure 23:
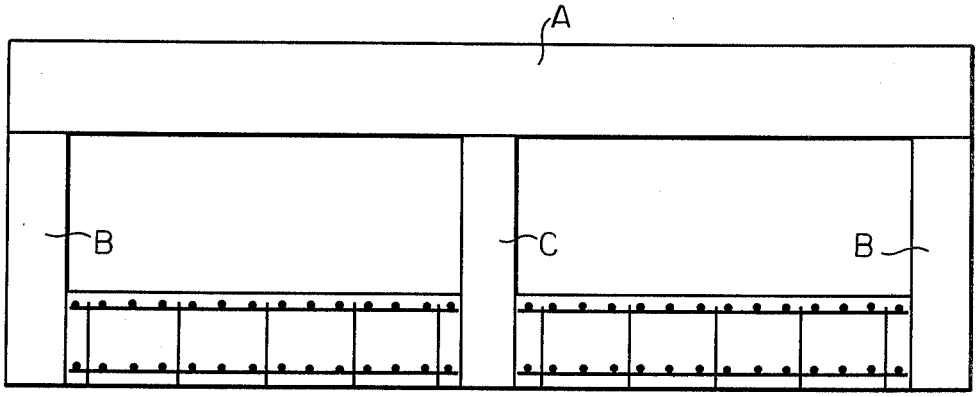
FIG. 23 is a sectional view illustrating the formation of a tunnel floor.
Figure 24:
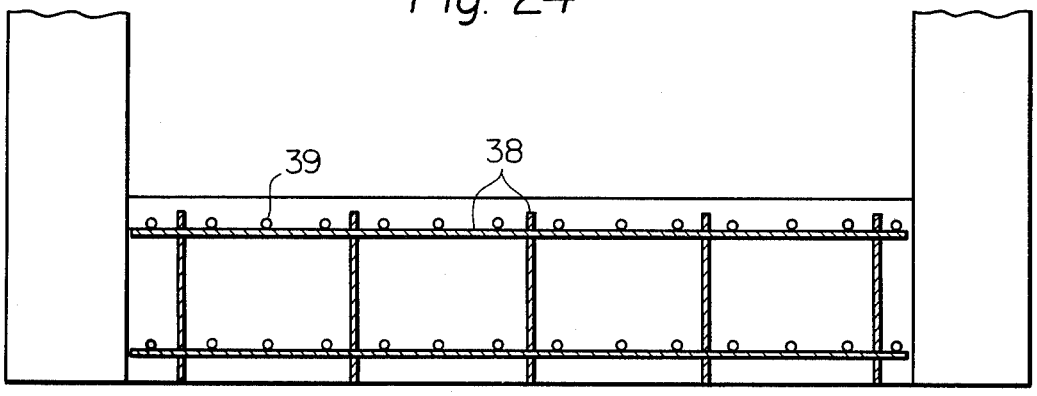
FIG. 24 is a sectional view illustrating the system of setting up reinforcing structure for the tunnel floor.

[D] Formation of Tunnel Floor Portions (FIGS. 23 and 24 inclusive)

On the bottom of each hollow tunnel chamber formed by the above-mentioned process, are disposed a main reinforcing bar and a sub-reinforcing bar. Then concrete is filled in to form the tunnel floors. Preferably each floor portion D has a thickness equal to that of the artificial roof A so as to make the whole construction symmetrical in both vertical and horizontal directions, from the standpoint of improved resistance to ground rock pressure.

FIG. 23 illustrates the disposition of the reinforcing bars, and FIG. 24 is an enlarged partial view thereof. Preferably, a sub-reinforcing bar 38 is first constructed on the bottom of each tunnel chamber and thereafter the reinforcing bar 39 is built up. Raw concrete is spread on the bottom by means of a raw concrete supply pipe, and is filled up to a predetermined height or thickness.

Elongated tunnel floor portions D are thus formed. Tracks, driveways and side ditches can be appropriately installed, depending on the objects and needs of the particular tunnel.

By the performance of operations to form portions A, B, C and D, an underground construction having rectangularly shaped and longitudinally extended cavities are formed, which construction serves as a rectangular tunnel of greater width than is possible in prior art construction methods.

Figure 25:
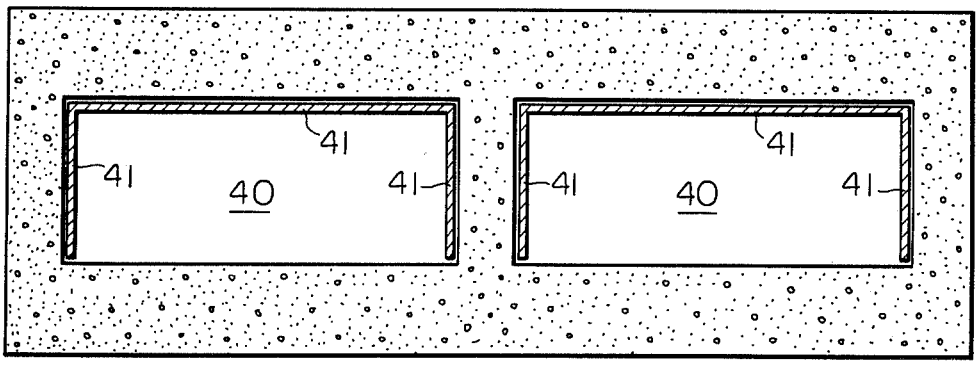
FIG. 25 is a sectional view illustrating the inner surface of the rectangular tunnel.

FIG. 25 is a cross section illustrating the completed tunnel. Preferably a sound absorbing plate 41 is applied to the inner surface of each tunnel section 40 with insignificant space therebetween. The plate 41 also serves as a drainage means. Since the underground construction according to the present invention is sometimes constructed without using forms, the walls thereof may have uneven surfaces. The sound absorbing plate 41 conceals such unevenness and at the same time facilitates disposal of leakage of water.

A two-story tunnel, as shown in FIG. 26, can be constructed by constructing another tunnel just below the first tunnel through the same processes as described above. In this case, the floor of the upper tunnel is used as the artificial roof of the lower tunnel. The floor of the upper tunnel which is also the lower tunnel has the frames thereof somewhat strengthened as compared to those shown in the drawings. Also the side wall pillars B' of the lower tunnel may have a larger thickness than those of the upper tunnel.

There are alternative processes for constructing the two-story tunnel shown in FIG. 26. For instance, the lower tunnel may be constructed first, and then the upper tunnel may be constructed in accordance with the processes described above. Further, the upper tunnel may be first formed to have the side wall pillars and the center wall pillar of sufficient height for two stories, and thereafter, an intermediary slab may be formed to act as the floor of the top story and the roof of the bottom. These processes can be properly employed and introduced to be accommodated to the particular geological conditions involved, and even a multi-story tunnel can be formed according to the method of the present invention.

The rectangular tunnel formed according to the present invention does not have the useless facing area inherent in prior art tunnels having a curved cross section (semi-circular or semi-oval).

Since all portions of the rectangular tunnel chambers can be effectively used, the efficiency of use is improved. According to the present invention the width of the tunnel can be enlarged to an extent not possible with prior art techniques and therefore can deal with a heavy traffic without fail. The construction of the tunnel can be carried out in high safety to bring about a solid structure.

What is claimed is:

1. A method for constructing a rectangularly shaped tunnel through an earth body, said method comprising:

constructing an artificial tunnel roof by:

excavating a gateway shaft through an earth body in a direction along the length of an intended tunnel;

sequentially excavating a plurality of cross cut shafts through said earth body from opposite sides of said gateway shaft in opposite lateral directions transverse to the length of the intended tunnel, and sequentially filling said cross cut shafts with concrete, whereby a given said cross cut shaft is excavated immediately adjacent a preceding said cross cut shaft after the said concrete therein has solidified; and filling said gateway shaft with concrete, whereby said concrete filling said cross cut shafts and said gateway shaft together form an integral tunnel roof;

constructing vertical wall pillars directly beneath opposite lateral edge and central portions of said tunnel roof by:

sequentially excavating portions of said earth body directly beneath said opposite lateral edge and central portions of said tunnel roof, to thereby form vertical wall cavities extending along the length of the intended tunnel; and filling said vertical wall cavities with concrete, to thereby form vertical wall pillars, which together with said tunnel roof cover inner block portions of said earth body;

removing said inner block portions of said earth body, to thereby form rectangularly shaped hollow tunnel chambers extending along the length of the intended tunnel; and forming concrete layers on the bottom surfaces of said hollow tunnel chambers, to thereby form tunnel floor portions.

2. A method as claimed in claim 1, further comprising, before filling said concrete in each of said cross cut shafts, said gateway shaft, said vertical wall cavities and the volumes occupied by said tunnel floor portions, constructing metal frames therein, such that said metal frames are thereafter imbedded in said concrete.

3. A method as claimed in claim 2, wherein said metal frames in said tunnel roof are connected, said metal frames in said vertical wall pillars are connected, and said metal frames in said tunnel floor portions are connected.

4. A method as claimed in claim 1, wherein said vertical wall cavities are sequentially excavated in plural layers.

5. A method as claimed in claim 1, wherein said inner block portions are removed by forming longitudinal shafts through lower central portions of said inner block portions, and then blasting away said inner block portions from said longitudinal shafts.

6. A method as claimed in claim 1, further comprising forming another tunnel above said rectangularly shaped tunnel by using said tunnel roof as a floor for said another tunnel.

7. A method as claimed in claim 1, further comprising forming another tunnel below said rectangularly shaped tunnel by using said tunnel floor portions as a tunnel roof for said another tunnel.

8. A method as claimed in claim 1, wherein said step of constructing said artificial tunnel roof further comprises evacuating a lower gateway shaft at a position below said first-mentioned gateway shaft, excavating a plurality of longitudinally spaced upper connecting shafts laterally from opposite sides of said first-mentioned gateway shaft in opposite lateral directions transverse to the length of the intended tunnel, evacuating a plurality of lower connecting shafts below said upper connecting shafts from opposite sides of said lower gateway shaft in opposite lateral directions transverse to the length of the intended tunnel, excavating vertical service shafts between vertically aligned outer ends of said upper and lower connecting shafts, and excavating a plurality of longitudinally spaced vertically extending evacuation chutes between said first-mentioned and said lower gateway shafts.

* * * * *